United States Patent [19]

Booland

[11] 3,984,930

[45] Oct. 12, 1976

[54] APPARATUS FOR SHOWING MATERIALS AND COMBINATIONS OF MATERIALS

[76] Inventor: Bernhard Tellekamp Booland, Waterlandplein 10, Amsterdam, Netherlands

[22] Filed: June 9, 1975

[21] Appl. No.: 584,725

Related U.S. Application Data

[63] Continuation of Ser. No. 398,795, Sept. 19, 1973, abandoned.

[30] Foreign Application Priority Data

Sept. 19, 1972 Netherlands ..... 7212688
July 5, 1973 Netherlands ..... 7309429

[52] U.S. Cl. ..... 40/65; 52/64; 35/55

[51] Int. Cl.[2] ..... G09F 11/30

[58] Field of Search ..... 40/65; 35/49, 53, 50, 35/55; 312/234; 52/64; 211/46

[56] References Cited

UNITED STATES PATENTS

| | | | |
|---|---|---|---|
| 2,812,067 | 11/1957 | Gussack | 211/46 |
| 3,181,274 | 5/1965 | Izenour | 52/64 X |
| 3,235,915 | 2/1966 | Glaser | 52/64 |
| 3,732,633 | 5/1973 | Margolis et al. | 35/55 |
| 3,748,793 | 7/1973 | Tompkins et al. | 52/64 |

FOREIGN PATENTS OR APPLICATIONS

| | | | |
|---|---|---|---|
| 1,289,276 | 2/1969 | Germany | 35/55 |

*Primary Examiner*—Louis G. Mancene
*Assistant Examiner*—John H. Wolff
*Attorney, Agent, or Firm*—Fleit & Jacobson

[57] ABSTRACT

An apparatus for displaying materials and combinations of materials including a main rail and a plurality of side rails positioned serially one after each other. At least one side of each side rail is connected to the main rail by a switch. A plurality of panels on which the materials to be displayed are mounted are connected to the main and side rails by moving means such as guide rollers so that the panels can be moved along the rails. Each of the moving means includes a vertical shaft on which one of the panels is mounted with the panels being freely rotatable about the vertical shaft. The side rails are spaced apart from each other a distance greater than or at least substantially equal to the width of the panels.

5 Claims, 11 Drawing Figures

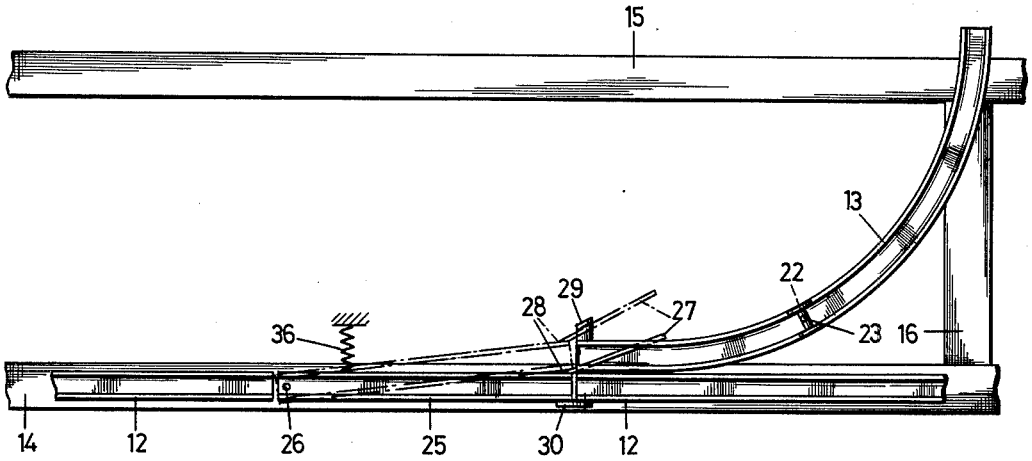
FIG. 3
FIG 4
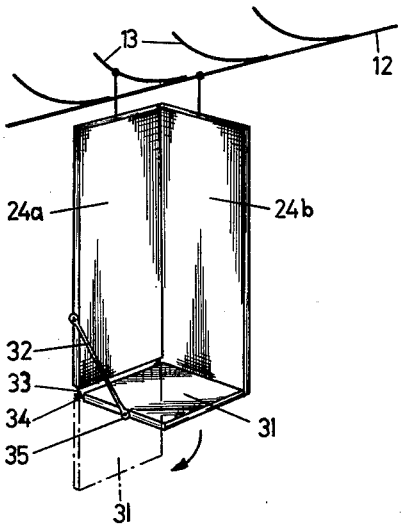
FIG. 5
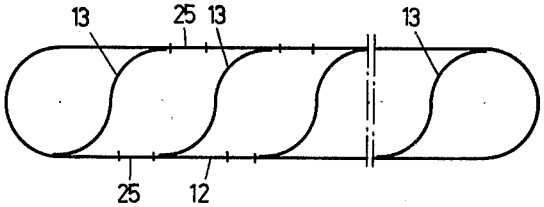
FIG. 6
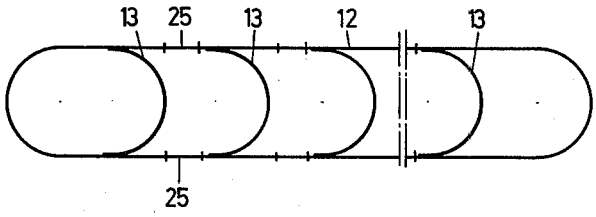

APPARATUS FOR SHOWING MATERIALS AND COMBINATIONS OF MATERIALS

This is a continuation application of Ser. No. 398,795, filed Sept. 19, 1975 now abandoned.

The invention relates to an apparatus for showing materials, such as wall-paper, curtain materials, vitrage-cloth, carpets, wall-finishing materials, and the like, and in particular the combination of such materials, which apparatus comprises a main-rail, a desired number of side-rails positioned one after each other and connected at least at one side through a switch to the main-rail, and panels or other bearing members, upon which or to which the materials are mounted, which by means of guide-rollers are movable over the rails.

From the published Dutch patent application 6,501,625 an apparatus is known for storing and showing carpets, by which a desired number of storing-rails are positioned mutually parallel one after each other, which rails at one side merge into a main-rail and carpets, connected to suspending members, are movable over the rails by means of rollers. At the transition places of a storing-rail into the main-rail a pivotal switch is provided which can close the storing-rail, which switch can be opened into the direction of the main-rail against the pressure of a spring.

Such an apparatus has the disadvantage that a carpet from the collection of carpets, suspended from the storing-rails, can be entirely shown only by bringing it to the main-rail. Another disadvantage is that two or more carpets can only entirely can be entirely compared with each other by bringing them alongside of each other upon the main-rail. Moreover, carpets shown in this way have to be brought back to their storing-rail if one intends to use the main-rail for further comparisons or combinations. All this is time-consuming and moreover requires much space. The room intended for the showing cannot suitably be used.

Further it is known to show materials by means of pattern-books or pattern-carriers, the patterns for example being stretched upon frames, each being rotatable around a fixed hinge for example at a wall. The disadvantage of such apparatus is that only the patterns on frames alongside each other at a desired angle can be compared or combined with each other. Therefore the number of possibilities for comparison is very limited.

The purpose of the invention is to remove these disadvantages. According to the invention this purpose is achieved in that the side-rails are positioned one after each other at a distance equal to or larger than the width of the panels and each panel with material is connected to at least one roller by means of a connecting part which is freely movable around a vertical shaft with respect to the roller. Accordingly more panels can be suspended one each side-rail which all can be seen at an oblique or bent angle to the side-rails. By these means it easily is possible to look for and to make a combination to be studied. Moreover, the room for the showing can be used more suitably. With the known apparatus the panels all hang in one corner of the wall if the apparatus is positioned along a wall. The apparatus according to the invention can occupy the entire wall. Because the panels are rotatable it is possible to position the panels at an angle with respect to each other and to try out different light gradations.

According to the invention the apparatus also can be constructed such that the panels are provided with connecting means for positioning other panels in a horizontal position. These can be hook members. Herewith it is possible to make still more combinations such as wall-paper combinations on the vertical panels with a carpet on the horizontal panel.

According to the invention the switch can comprise a rail-portion, which is hingeably connected around a vertical shaft, the rail-portion being held in a position linked up with the main-rail and being forced to a position linked up with the side-rail by means of a spring, the switch-rail-portion being provided with a part slipping through an opening into the side-rail, by means of which a guiding-roller pressing against this part can displace the switch from the position not connected to the side-rail, to the position connected to the side-rail. Herewith it is achieved that movements in the continuous main-rail freely can take place, each panel coming from side-rail operating the switch and for being brought back into the side-rail requiring a light pressure must be exerted, through which the switch connects to the side-rail and when moving the pattern from the switch-rail-portion into the side-rail, it is supported by the tongue and the switch automatically comes back into the straight position.

According to the invention it is also possible to construct the apparatus such that the main-rail and side-rails consist of the same shallow tubular profile with groove and the connection always is formed by a T-piece in which or upon which main-rail and side-rails can be shifted. In this way a very simple construction is obtained which is built up from tubular profile pieces and T-pieces. Preferably the apparatus consists of apportioned lengths of tubular profile. These lengths can be obstructed from each other at the required intervals by ridges present in the T-piece to make the connection to the groove and the side-rail possible. It, however, is also possible to connect the lengths of tubular profile obtusely to each other when at the position of one side-wall and the half of the bottom the ends are shortened over a distance which at least is equal to half the width of the groove in the bottom of the profile. As guiding means preferably a flat disc is used. This embodiment is very simple while no switch to be operated is necessary.

According to the invention it is also possible that the T-piece consists of a tubular profile, open at the bottom, for taking up a side-rail, upon which tubular profile a cross-sectional hook-like part is connected, gripping over upper, outer and lower edge of the main-rail, the main-rail having excisions at the edge turned towards the side-rail, in which excisions side-portions of the tubular profile of the T-piece fit.

The invention now will be further explained with respect to the drawings.

FIG 3 is a bottom view of the switch part of the apparatus.

FIG. 4 is a perspective view showing another possiblity for combinations according to the invention.

FIG. 5 and FIG. 6 are upper views of other embodiments of the rail-system of the apparatus.

Figure 1:
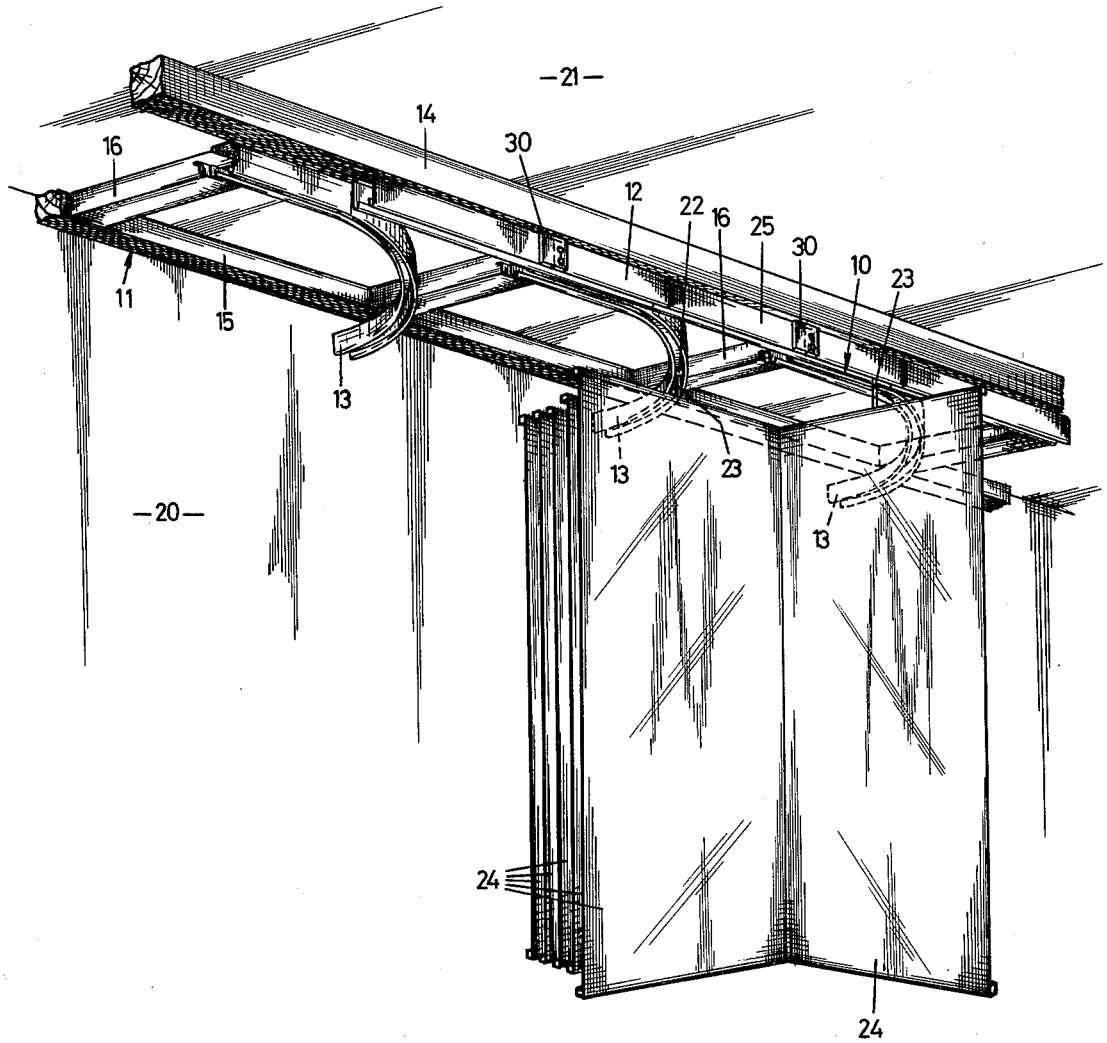
FIG. 1 is a perspective view of a part of the apparatus according to a preferred embodiment of the invention.
Figure 2:
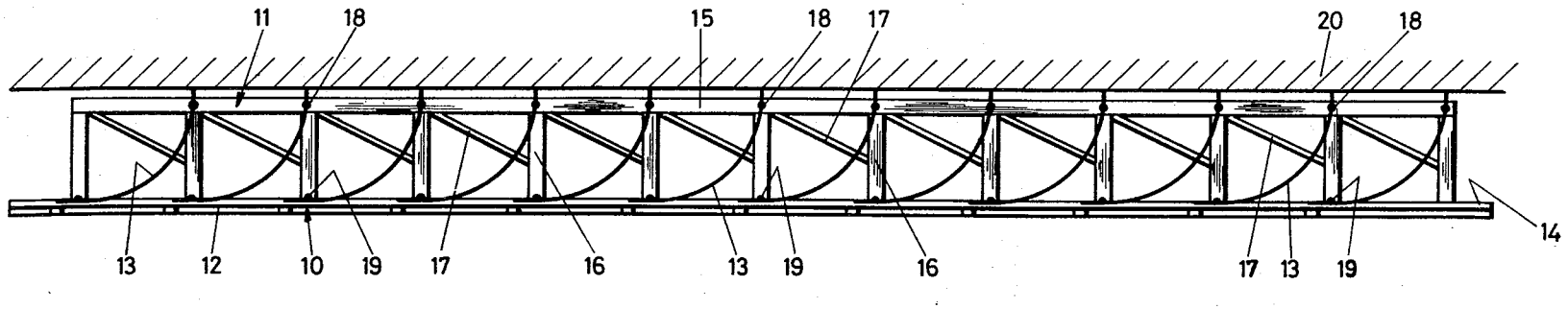
FIG. 2 is a bottom view of a complete apparatus according to the invention.

A preferred embodiment of the apparatus according to the invention comprises a rail-construction 10 and a wooden supporting construction 11 to which the rail-construction is connected, as shown in FIGS. 1 and 2. The rail-system 10 comprises a main-rail 12 and a desired number of arched side-rails 13 guiding to the main-rail 12. At the place of the transition of each side-rail 13 to the main-rail 12 a switch is constructed as described below. The supporting construction 11 comprises two longitudinal beams 14 and 15, a number of transverse beams 16 and supports 17. The main-rail 12 is connected to the longitudinal beam 14 by means of bolts, and each side-rail is connected at two points 18 and 19 by means of bolts to the transverse beams 16. The supporting construction 11 preferably is connected to a wall 20, but also can be connected to the ceiling 21 or left out, the rail-system directly being connected to the wall 20 or ceiling 21 or being part of an upright apparatus. The rail-system 10 serves for carrying and guiding the guide-rollers 22, which are connected to hanging panels 24 by means of connecting parts 23 or differenty shaped supports, upon which or to which the materials or samples to be shown are connected. Each panel 24 at the upper side is provided with one connecting member 23 freely rotatable around a vertical shaft with respect to the support roller or rollers mounted at it, so that each hanging panel 24 can be rotated by hand in each desired position. The panels 24 at both sides and over the entire surface are provided with one or more materials or samples thereof, which have to be shown. The size of the panels 24 is atuned to the desired size of the samples or patterns to be shown. The horizontal distance between the arched rail-parts 13 and the distance between the longitudinal rail 12 and the wall 20 is atuned to the size of the panels 24. To each arched portion 12 a number (for example five) of such panels 24 are suspended. The apparatus shown in FIG. 2 comprises 12 arches 13 and carries totally 60 panels with totally 120 samples to be shown. Each panel 24 is free to be replaced along the rail-construction 10 of the apparatus by means of the guide-rollers 22 in the rails. At the place of the transition of each arched rail-portion 13 to the longitudinal rail 12 a switch 25 is constructed which switch will be described below. According to the invention any panel 24 can be brought to and near any other panel by hand in an easy and fast way along the rail-construction 10 in order to combine the materials shown on those panels. The panels brought to each other can be rotated with respect to each other at any desired angle around their vertical axis of rotation. If one, for example, wants to combine wall-clothing for two walls perpendicular to each other, one rotates the selected panels until their surfaces make an angle of 90° with each other. The inner edges of these panels can be hooked together if desired. The combination can take place while one panel is at the arched portion 13 and the other panel, brought to it, is at the longitudinal rail 12. After the combination the last-mentioned panel preferably is brought back in its original position at an arched portion 13 in order to make free the longitudinal rail 12 for other combinations. It will be clear that each panel 24 can be combined in this way with any other panel 24 present in the apparatus and at each desired angle. The panels 24 at each arched rail-portion 13 in the "stored" position preferably are suspended almost parallel one after each other and at some mutual distance through which not only the front panel but also the extending side part of each other panel is visible to someone walking along the apparatus.

In FIG. 3 the switch 25 of the apparatus is shown in detail. In the bottom view the deflected position is indicated in dotted lines. The switch 25 consists of a rail-portion which in the normal not deflected starting position is in line with the main-rail 12. The switch 25 is rotatably mounted around a vertical shaft 26 upon the supporting construction 11 and can be rotated against spring pressure into a position forming a continuous connection between the side-rail 13 and the main-rail 12 as shown in dotted lines. Upon switch 25 a tongue 27 positioned at a certain angle is securely mounted by 28 at the side of switch 25. The tongue 27 is put through an opening into the side-wall of the rail 13, which opening near the end of this rail 13 is closed by an abutment 29 being securely mounted to the side-rail 13 and limiting the movement of the switch 25 in one direction. The movement of the switch 25 in the other direction is limited by an abutment 30 securely mounted upon the main-rail 12. If a panel 24, positioned upon the side-rail 13 is guided to the main-rail 12 the guide-roller or rollers 22 run against the tongue 27 of the switch 25 and pushes the entire switch to the position shown in FIG. 3, the switch 25 hinging around a vertical shaft 26 until it rests against the abutment 29. The roller 22 then can continue on its way and can be brought onto the main rail 12 through the switch 25. The panel 24 now can be moved freely along the main-rail 12 to the desired position, provided that all other switches 25 to be passed are in line with the main-rail 12. Each deflected switch 25 is brought back in the normal not deflected position by the spring 36. Each switch 25 can be pushed by hand into the deflected position to bring a panel 24 into a certain side-rail 13 by pushing this panel backwards.

In FIG. 4 a third possibility to combine, according to the invention, is shown. At the bottom-side or the side-edges of a suspending panel 24 another panel 31 is connected. The panel 31 is, preferably at both sides, provided with a floor-covering material. The material on panel 31 can be combined with a material on panel 24. For this purpose a panel 31 is releasably suspended on a panel 24 by means of simple connecting means, then moved from the vertical into the horizontal position and thereafter into the horizontal position, for example by hooks 32 shown in FIG. 4. At the side-edge of panel 24 a hook 32 is connected which can be hooked with the free end to a panel 31. At the bottom-side of the panel 24 eyes 33 are constructed and at the side of the panel 31 cooperating hooks 34 are mounted. After moved the panel 31 into the horizontal position the panel 31 can be fixed by hooking the hook 32 around the pin 35 at the panel 31. Thus it is possible to combine each panel 31 with each panel 24. Further it is possible to combine the panel 31 with two or even three panels 24. In FIG. 4 a combination is shown with two panels 24*a* and 24*b*. The panel 31 can be connected, if desired, to panel 24*a* as well as to panel 24*b*.

In a similar way it is possible to provide a fourth combination-possibility for ceiling panels, for example panels having different colours which can be connected to the upper side of a panel 24.

In FIGS. 5 and 6 other embodiments of rail-constructions 10 are shown. In FIG. 5 the rail construction comprises a continuous main-rail 12 with intermediate side-rails 13 directing at both sides to the main-rail 12 and being connected to it by means of switches. In FIG. 6 the side-rails 13 almost form a semi-circle.

It will be clear that many modifications and/or changes in the apparatus according to the invention can be made. For example, the apparatus can be constructed continuously along at least two walls making an angle with each other. The rail-construction 10 shown in FIGS. 5 and 6 does not necessarily have a closed main-rail 12. The main-rail 12 can be arched. The side-rails 13 can be constructed differently. There are numerous embodiments possible for the switch 25.

Further it is possible to construct a rail-system below and above the apparatus, shown in FIG. 2, to show floor and ceiling panels, respectively, these panels being combined with suspended panels 24.

Figure 7:
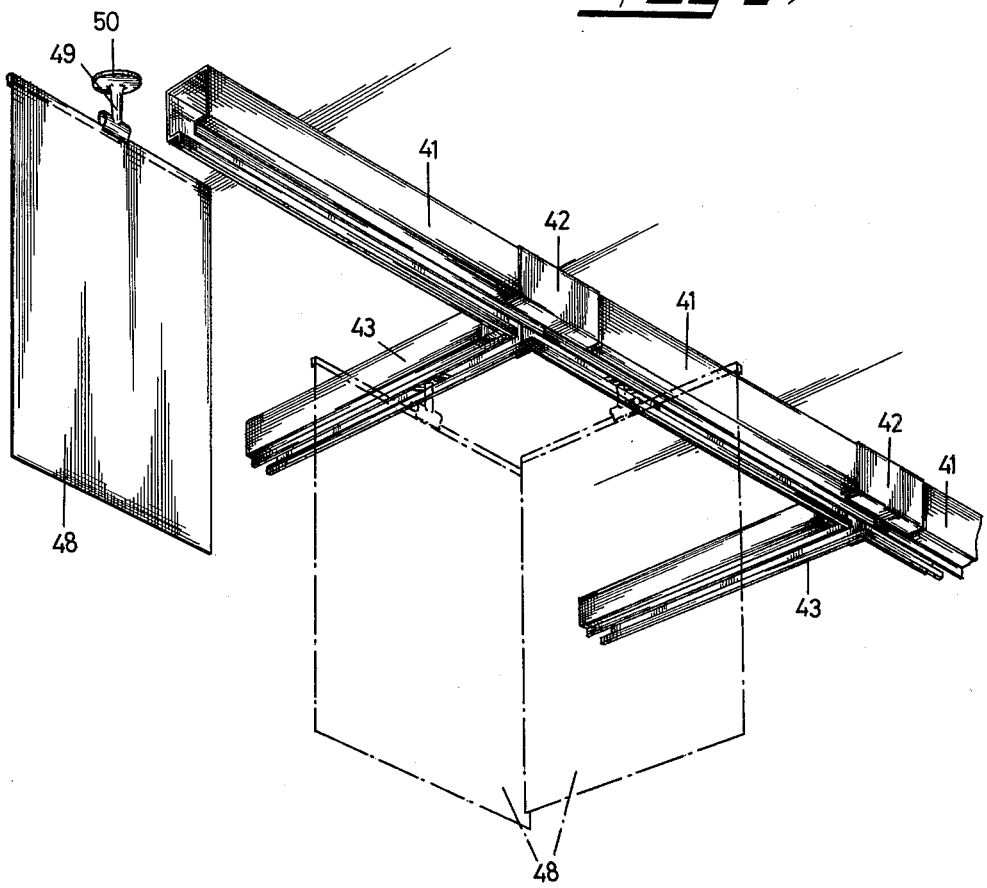
FIG. 7 shows in perspective the apparatus according to the invention.

The apparatus shown in FIG. 7 consists of a number of pieces of tubular profiles 41 of preferably equal length and of a cross-section as indicated in the left portion of FIG. 7. These profile portions are put into the ends of a T-shaped connecting part 42 in which side-rails 43 of the same profile material are put.

Figure 8:
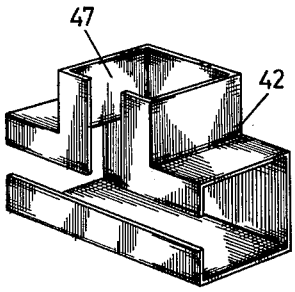
FIG. 8 shows in perspective and seen from the bottom the T-shaped connection part.
Figure 9:
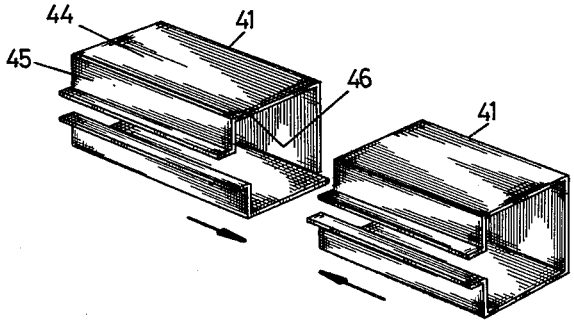
FIG. 9 shows the way of manufacturing the ends of the profile parts.

The shape of the T-piece 42 is clearly shown in FIG. 8. This T-piece, which can be made of metal or synthetic material, has a T-shaped groove for connecting it to the grooves in the lower side of the tubular profile portions. These profile portions are put into the T-piece such that they obtusely are connected to each other, as shown in FIG. 9. In order to obtain a connection at the groove to the side-rail the side-wall 44 and the lower edge 45 are cut away at 46 over a width being equal to half the width of the groove 47 of the T-piece 42 so that a good connection is guaranteed. FIG. 7 shows in which way a panel 48 through a vertical pin 49 and a flat disc 50 easily removable can be inserted in the apparatus.

It is observed that the apparatus also can be constructed such that the main rail consists of one portion in which the T-pieces are put, by which in the main-rail windows have to be cut out at those places where the side-rails have to be connected.

Instead of locally cutting away the ends of the portions forming the main-rail (the side-rails do not need an adaptation at the ends) it is also possible not to adapt the ends of the tubular profile but to provide the T-pieces with an inner ridge serving as a stop.

Figure 10:
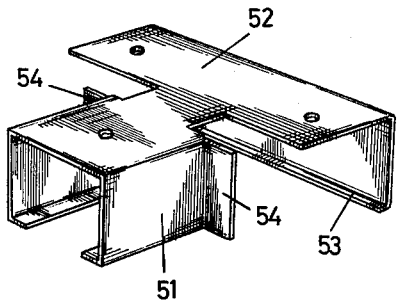
FIG. 10 shows a somewhat different embodiment of the T-piece.
Figure 11:
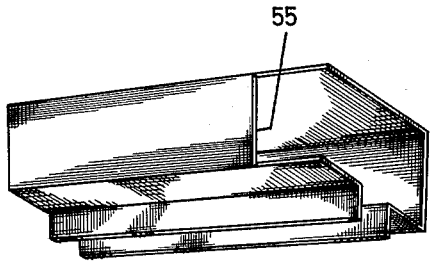
FIG. 11 shows the end of the main-rail belonging thereto.

In the embodiment, shown in FIGS. 10 and 11, T-piece comprises a tube 51, open at the bottom side, in which the end of a side-rail 13 can be put. At this tube a plate 52 is mounted being squarly bent twice gripping the plate with the edge 53 around the main-rail profile. The tube 51 has side-wings 54 fitting into the openings 55 of the main-rail profile. In this way a simple snap connection is obtained.

What we claim is:

1. An apparatus for displaying materials and combinations of materials comprising a main-rail, a plurality of side-rails positioned serially one after each other, switch means connecting at least one side of each rail to said main-rail, a plurality of panels on which the materials to be displayed are mounted, said side-rails being spaced apart from each other a distance at least substantially equal to the width of one of said panels, wherein each of said main-rail and said side-rails has a tubular shape with a slot formed in the bottom wall and said switch means comprises a T-shaped member to which said main-rail and said side-rails are connected, each said T-shaped member consisting of a first tubular portion open at the bottom to which one of said side-rails is connected and a second portion having a hook-shaped cross-section connected to said first tubular portion for gripping over the upper, outer and bottom walls of said main-rail, said main-rail having openings at the side facing said side-rails, and said first tubular portion having side wings fitting into said openings, and guide roller means for connecting each panel to said main and said side-rails so that each of said panels is freely rotatable and for moving said panels along said rails, each of said guide roller means including a vertical shaft on which one of said panels is mounted.

2. An apparatus for displaying materials and combinations of materials mounted on panels and orienting such materials in juxtaposed cooperative positions comprising:

a main-rail, a plurality of spaced apart side-rails, switch means connecting at least one side of each side-rail to said main-rail, a plurality of panels on which the materials to be displayed are mounted, at least some of said panels being provided with connecting means for the installation of other panels in horizontal position, said side-rails being spaced apart from each other a distance at least substantially equal to the width dimension of one of said plurality of panels, means for mounting said rails in an overhead location, and guide means for selectively connecting each panel to said main and side-rails so that each of said panels is freely rotatable and for moving said panels along said side-rails, each of said guide means including a vertical shaft on which one of said panels is mounted, said vertical shaft being adapted to be attached to an associated panel substantially at the midpoint of said associated panel width dimension.

3. An apparatus for displaying materials and combinations of materials mounted on panels and orienting such materials in juxtaposed cooperative positions comprising:

a main-rail, a plurality of spaced apart side-rails, switch means connecting at least one side of each side-rail to said main-rail, a plurality of panels on which the materials to be displayed are mounted, said side-rails being spaced apart from each other a distance at least substantially equal to the width dimension of one of said plurality of panels, means for mounting said rails in an overhead location, and guide means for selectively connecting each panel to said main and side-rails so that each of said panels is freely rotatable and for moving said panels along said side-rails, each of said guide means including a vertical shaft on which one of said panels is mounted, said vertical shaft being adapted to be attached to an associated panel substantially at the midpoint of said associated panel width dimension, said switch means comprising a rail portion pivotally mounted around a vertical shaft, spring means biasing said rail portion toward a position connecting said rail portion with said main-rail, an opening in each of said side-rails, and tongue means connected to each of said rail portions and extending through said opening, said tongue means adapted to be engaged by said guide means so that said rail portion is moved against the bias of said spring means to a position connecting said rail portion with one of said side-rails when said panel is moved along said one of said side-rails toward said main-rail.

4. The apparatus of claim 3 in which said main-rail consists of a plurality of appropriately sized lengths of said tubular shape with said slot formed in said bottom wall.

5. The apparatus of claim 4 in which the length of a side wall and half of the width of said bottom wall of the facing ends of each of said lengths of main rail are shorter than the remaining walls by a distance equal to half the width of said slot in said bottom wall of each main-rail.

* * * * *